United States Patent [19]

Saito et al.

[11] Patent Number: 4,795,992

[45] Date of Patent: Jan. 3, 1989

[54] MOUNT FOR DIELECTRIC COAXIAL RESONATORS

[75] Inventors: Koji Saito; Tadahiro Yorita; Hiroshi Okawa, all of Kanazawa, Japan

[73] Assignee: Murata Manufacturing Co., Ltd., Japan

[21] Appl. No.: 940,975

[22] Filed: Dec. 12, 1986

[30] Foreign Application Priority Data

Dec. 16, 1985 [JP] Japan ..... 60-283954

[51] Int. Cl.[4] ..... H01P 1/205; H01P 7/04

[52] U.S. Cl. ..... 333/206; 333/202; 333/222

[58] Field of Search ..... 333/202–219, 333/222–231, 235, 236, 239, 243, 185, 245

[56] References Cited

U.S. PATENT DOCUMENTS

| | | | |
|---|---|---|---|
| 2,714,192 | 7/1955 | Pan et al. | 333/202 |
| 4,053,835 | 10/1977 | Breitenbach | 333/243 X |
| 4,426,631 | 1/1984 | D'Avello et al. | 333/222 X |
| 4,567,454 | 1/1986 | Saito | 333/206 |

FOREIGN PATENT DOCUMENTS

| | | | |
|---|---|---|---|
| 0038996 | 4/1981 | European Pat. Off. . | |
| 0093956 | 4/1983 | European Pat. Off. . | |
| 358565 | 4/1938 | Italy | 333/222 |
| 0005605 | 1/1985 | Japan | 333/17 L |
| 0248003 | 12/1985 | Japan | 333/205 |

OTHER PUBLICATIONS

Horton et al.—"The Digital Elliptic Filter—", IEEE Trans. on Microwave Theory and Techniques, vol. MTT-15, No. 5, May 1967; pp. 307–314.

"Webster's Seventh New Collegiate Dictionary", C & G Merriam Company, Springfield, Mass., U.S.A., Copyright, 1965; p. 4.

*Primary Examiner*—Marvin L. Nussbaum

*Attorney, Agent, or Firm*—Ostrolenk, Faber, Gerb & Soffen

[57] ABSTRACT

An assembly which comprises a plurality of dielectric coaxial resonators, each comprising a generally elongated, polygonally-sectioned dielectric body having a hollow coaxially defined therein so as to extend completely through the length of the dielectric body, and also having inner and outer conductors formed respectively on inner and outer peripheral surfaces thereof, and a mount for the support thereon of the coaxial resonators. The mount has side abutments set up from the mount for engagement with respective sides of the coaxial resonators whereby the position of each coaxial resonator relative to the mount can be restricted by the corresponding side abutments.

11 Claims, 3 Drawing Sheets

MOUNT FOR DIELECTRIC COAXIAL RESONATORS

BACKGROUND OF THE INVENTION 1. (Field of Technology)

The present invention relates to a mount for the support thereon of dielectric coaxial resonators such as those used in, for example, a microwave filter or the like.

2. (Description of the Prior Art).

A commerically available dielectric coaxial resonator 1, which may be for example, a quarter-wavelength coaxial TEM resonator, is shown in FIG. 1 of the accompanying drawings. The resonator 1 has a dielectric body 4 made of, for example, a ceramic material of the titanium oxide type which is filled between inner and outer conductors 2 and 3. More specifically, the coaxial TEM resonator 1 comprises a tubular dielectric body 4 having a relatively great wall thickness. The inner and outer peripheral surface of the body 4 have , for example, a silver paste, which is excellent in high frequency conductivity and also in bondability, applied and baked thereon to form the inner and outer conductors 2 and 3, respectively. A hollow is defined inside the inner conductor 2, into which hollow an elongated center rod 5 made of a similar ceramic material and having a length greater than the axial length of the dielectric body 4 is either inserted or fixed, depending on the needs, with one end 6 of said center rod 5 protruding outwardly from an open end face 7 of the resonator 1. That end 6 of the center rod 5 is coated, or otherwise covered, with an electrode layer 8 which is a continuation of the inner conductor 2. At the opposite end of the resonator 1 remote from the projecting end 6, the inner and outer conductors 2 and 3 are electrically connected together by means of an electrode 9.

Another commercially available resonator 11, which does not make use of the center rod 5, is partially shown in FIG. 2 of the accompanying drawings. The resonator 11 shown in FIG. 2 is provided with a terminal electrode 12 of any desired shape which is inserted into, and fixed by a deposit of an electroconductive bond material in, the hollow of the inner conductor 2, and electrically connected with the inner conductor 2. Where the resonator 11 is to be coupled with other electrtic components, for example, to be capacitively coupled with other resonators or connectors, chip capacitors 21 and 22 are used. Specifically, one end of the terminal electrode 12 protruding outwardly from the resonator 11 is machined to any desired shape, and first electrodes 23 and 24 of the respective capacitors 21 and 22 are connected to the machined end of the terminal electrode 12, the other electrodes 25 and 26 of the respective capacitors 21 and 22 being connected with the other resonators or connectors by way of respective lead lines 27 and 28.

When a microwave filter is assembled, a plurality having dielectric coaxial resonators 1 or 11 of the construction shown in FIG. 1 or 2, respectively, are aggregated together on a common support. More specifically, as shown in FIG. 3, which shows to the use of the dielectric coaxial resonators 1 having the construction shown in FIG. 1, the support, for supporting the coaxial resonators 1 to complete the microwave filter, is constituted by a grounded plate 31. The coaxial resonators 1 are mounted on the grounded plate in side-by-side fashion with their outwardly protruding ends 6 positioned on one side of the aggregation of the coaxial resonators 1. When they soldered to the grounded plate 31, with solder deposits 32 connecting firmly a portion of the outer conductor 3 of each coaxial resonator 1 to the grounded plate 31. Each two neighboring coaxial resonators 1 are also soldered together by a respective solder deposit 33 to provide a secure connection between the outer conductors 3 of the neighboring coaxial resonators 1.

When a microwave filter is assembled with the use of the coaxial resonators 11 having construction shown in FIG. 2, the coaxial resonators 11 are mounted and connected in a manner identical to that described with reference to and shown in FIG. 3.

Since each of the coaxial resonators 1 and 11 hitherto utilized is cylindrical in exterior shape, the coaxial resonators 1 or 11 when mounted on the grounded plate 31 define a line contact, not a surface contact, between each two coaxial resonators . The problem has often occurred of an insecurely fixing one or more of the coaxial resonators 1 or 11 to the grounded plate 31. In order to ensure rigid fixing, it has been suggested to use elastic pieces (not shown) between the coaxial resonators 1 or 11 and the grounded plate 31, or to form spring catches in a portion of the grounded plate 31, so that the coaxial resonators 1 or 11 can be fixed within an enclousre (not shown) while the outer conductors 3 of the respective coaxial resonators 1 or 11 are urged by the elastic pieces or the spring catches in the grounded plate 31, as disclosed in, for example, Japanese Laid-open Utility Model Publication No. 59-171401, published in 1984.

According to the suggested versions, special machining and/or molding is required to form the elastic pieces and the spring catches in the grounded plate 31, resulting in the increased cost of manufacture of the microwave filter as a whole.

Moreover, the presence of the solder deposit 33 between each two neighboring coaxial resonators 1 or 11 has been found to pose a problem in that, depending on the amount of solder used to form each solder deposit 33, the resultant microwave filter is susceptible to changes in operating characteristics to such an extent as to render difficult the adjustment of the operating characteristics thereof.

SUMMARY OF THE INVENTION

The present invention is intended to provide a mount for the support thereon of coaxial resonators, with which the fixing of the resonators by the use of a soldering technique can be easily and readily accomplished, and which makes it possible and easy to adjust the operating characteristics of each coaxial resonator even after the actual mounting of the coaxial resonators.

In order to accomplish the above described object, the present invention makes use of dielectric coaxial resonators each having a generally elongated dielectric body having a polygonal cross-sectional shape. A mount provided according to a feature of the present invention comprises a plate member having at least a plurality of side abutments, one for each dielectric coaxial resonator of polygonal cross-section, each of said side abutments being defined in the plate member for contact with a side surface of the respective coaxial resonator, and formed by slitting and being raising a portion of the plate member so as to lie generally perpendicular to the remaining portion of the plate member.

According to the present invention, the polygonal-sectioned coaxial resonators are mounted on the mount while being restricted in position by the respective side abutments integral with the plate member.

As hereinabove described, according to the present invention, the position of each polygonal-sectioned coaxial resonator on the mount is restrained by the corresponding side abutment, and therefore, the fixing of the coaxial resonators can be easily and readily accomplished. Also, electrical connection between the mount and the outer conductor of each coaxial resonator is restricted to taking place at a predetermined position, and therefore, the adjustment of operating characteristics to be performed subsequent to the fixing of the coaxial resonators on the mount can be easily accomplished. As a result, the present invention is effective to provide inexpensive and highly reliable filters.

BRIEF DESCRIPTION OF THE DRAWINGS

This and other objects and features of the present invention will become clear from the following description of preferred embodiments thereof with reference to the accompanying drawings, in which.

DETAILED DESCRIPTION OF THE EMBODIMENTS

Figure 1:
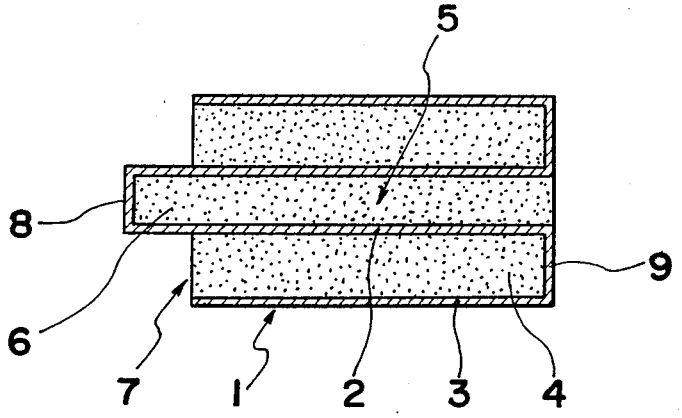
Fig. 1 Prior Art
FIG. 1 is a longitudinal sectional view of one type of prior art dielectric coaxial filter.
Figure 2:
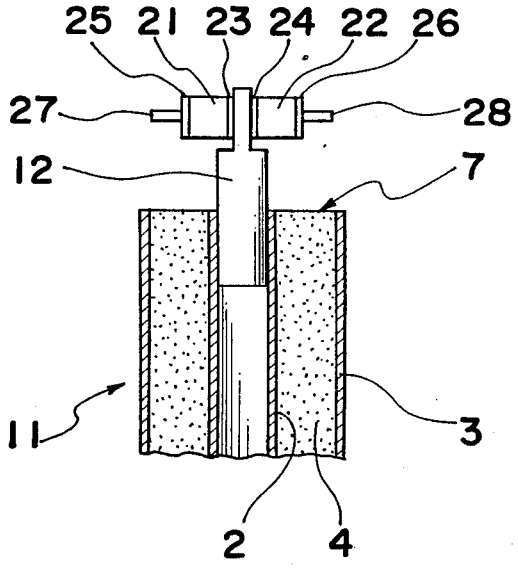
Fig. 2 Prior Art
FIG. 2 is a partial longitudinal sectional view of another type of prior art dielectric coaxial resonator.
Figure 3:
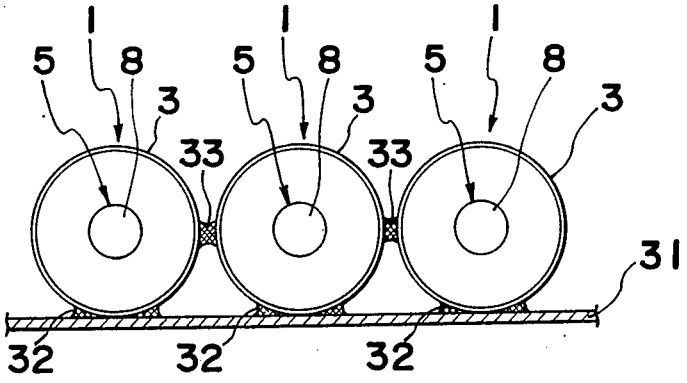
Fig. 3 Prior Art
FIG. 3 is a sectional view illustrating the prior art method for fixedly mounting coaxial resonators on a grounded plate.

Before the description of the present invention proceeds, it is to be noted that like parts are designated by like reference numerals throughout the accompanying drawings, except for FIGS. 1 to 3.

Figure 4:
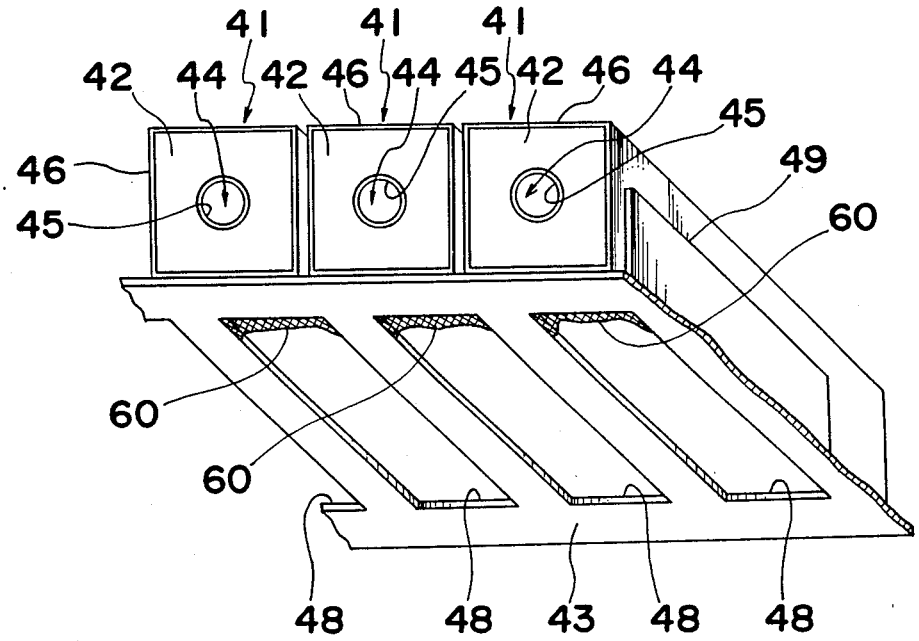
FIG. 4 is a perspective view of a portion of a mount according to a first embodiment of the present invention with dielectric coaxial resonators mounted thereon, as viewed from below.
Figure 5:
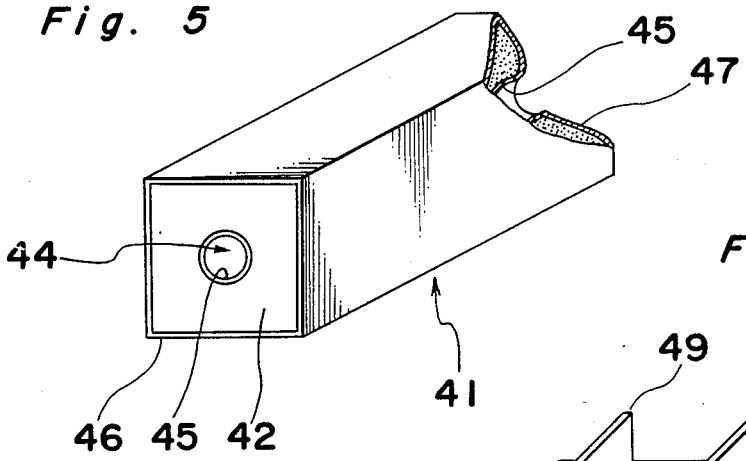
FIG. 5 is a perspective view, with a portion cut away, of a dielectric coaxial resonator used in the practice of the present invention.
Figure 6:
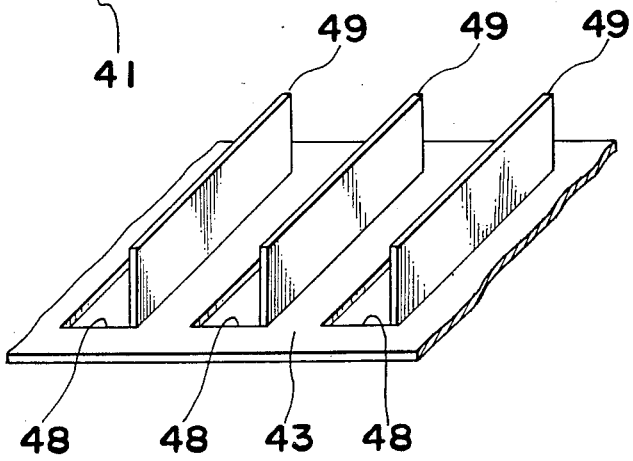
FIG. 6 is a perspective view of the mount shown in FIG. 4.

Referring first to FIGS. 4 to 6, dielectric coaxial resonators 41 utilizeable in the practice of the present invention have a generally polygonal cross-sectional shape, for exammple, a square shape as shown, and are of a type known as a quarter-wavelength TEM resonator. These dielectric coaxial resonators 41 are firmly mounted on a grounded plate 43 forming a mount while having been oriented in the same direction. As will be described later, if desired, the coaxial resonators 41 may be rigidly connected to the grounded plate 43 by means of solder deposits 60 or deposits of an electroconductive bond.

Each of the coaxial resonators 41 is made of a ceramic material of titanium oxide and comprises a generally elongated, square-sectioned dielectric body 42 having a hollow 44 defined therein and extending coaxially completely through the entire length thereof. The dielectric body 42 has, as best shown in FIG. 5, its inner and outer peripheral surfaces formed with inner and outer conductors 45 and 46, the inner and outer conductors 45 and 46 being shortcircuited, or otherwise electrically connected, together by means of a shortcircuiting conductor 47 applied or deposited only at one end face of the dielectric body 42.

The grounded plate 43 is made of a metallic material excellent in electroconductivity, for example, copper, brass or the like and has a plurality of side abutments 49 integrally formed therewith by the use of any known press work so as to extend parallel to each other while being spaced an equal distance from each other, which distance is substantially equal to the width of each square-sectioned coaxial resonator 41. Each of the side abutments 49 is formed by slitting a portion of the grounded plate 43 so as to form a generally U-shaped slit and then raising that portion of the grounded plate 43 so as to lie generally perpendicular to the remaining portion of the same plate 43 leaving a generally rectangular opening 48 in the grounded plate 48 which has been previously occupied by that portion of the grounded plate 43, that is, the side abutment 49, as best shown in FIG. 6.

The coaxial resonators 41 described with reference to and shown in FIG. 5 are mounted on the grounded plate 43 with each coaxial resonator 41 received in between the neighboring side abutments 49. With the coaxial resonators 41 so mounted, one of the surfaces of the respective outer conductors 46 thereof which confront the associated openings 48 are rigidly connected with the grounded plate 43 through solder deposits 60 each positioned inside the associated opening 48. Preferably, each of the solder deposits 60 is formed between the grounded plate 43 and one end of the surface of the outer conductor 46 of each coaxial resonator 41 remote from the shortcircuiting conductor 47 where a ground current flows, so that the characteristic of the coaxial resonator can be stabilized. Alternatively, or simultaneously therewith, a solder deposit may be formed between the outer conductor 46 of each coaxial resonator 41 and the neighboring side abutment 49.

In the construction as hereinabove described with reference to FIGS. 4 to 6, the dielectric coaxial resonators 41 can be held in surface contact with the grounded plate 43 and, therefore, not only can the operating characteristics of the respective resonators 41 be stabilized, but also the resonators 41 can be firmly retained in position on the grounded plate 43. Moreover, the outer conductors 46 of the respective resonators 41 can be soldered to the grounded plate 43 thorugh the individual openings 48, ensuring a rigid and film connection between the coaxial resonators 41 and the grounded plate 43. Furthermore, since each of the coaxial resonators 41 is retained in position between the neighboring side abutments 49, the coaxial resonator 41 can be steadily mounted on the grounded plate. Yet, since the position at which the respective solder deposit 60 is formed to connect the outer conductor 46 with the grounded plate 43 can be fixed once the axial orientation of the respective coaxial resonator 41 relative to the grounded plate 43 is determined, any possible deviation in operating characteristic among the coaxial resonators 41 can be substantially eliminated.

In the foregoing embodiment, the dielectric coaxial resonators 41 in the form as fixed on the grounded plate 43 constitute a circuit block such as, for example, a filter block, and if this circuit block is combined with any other suitable jig or jigs (not shown), the characteristic of the circuit block can be ascertained before a product incorporating the circuit block is completed. This enables the percentage of the number of non-defective products being manufactured to be increased.

Figure 7:
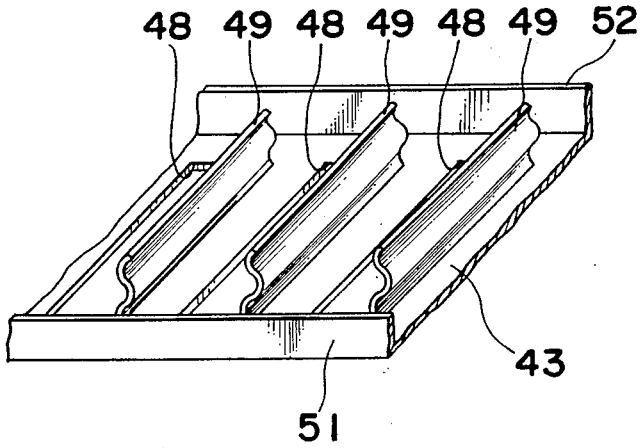
FIG. 7 is a view similar to FIG. 6, showing a mount according to a second embodiment of the present invention.

In the embodiment shown in FIG. 7, each of the side abutments 49 may be corrugated longitudinally thereof so that it can exert a resilient force sufficient to resiliently retain the associated dielectric resonator 41 in between the neighboring side abutments 49.

Also, as shown in FIG. 7, the grounded plate 43 may have its opposite side edges 51 and 52 bent to protrude perpendicular to the remaining portion of the grounded plate 43 in the same direction as that in which the side abutments 49 protrude, so that any possible axial displacement of the coaxial resonators 41 can be advantageously avoided and, also, the coaxial resonators 41 can be positioned on the grounded plate 43 with their opposite ends lined up uniformly. The presence of the bent side edges 51 and 52 in the grounded plate 43 advantageously increases the rigidity of the grounded plate 43.

Figure 8:
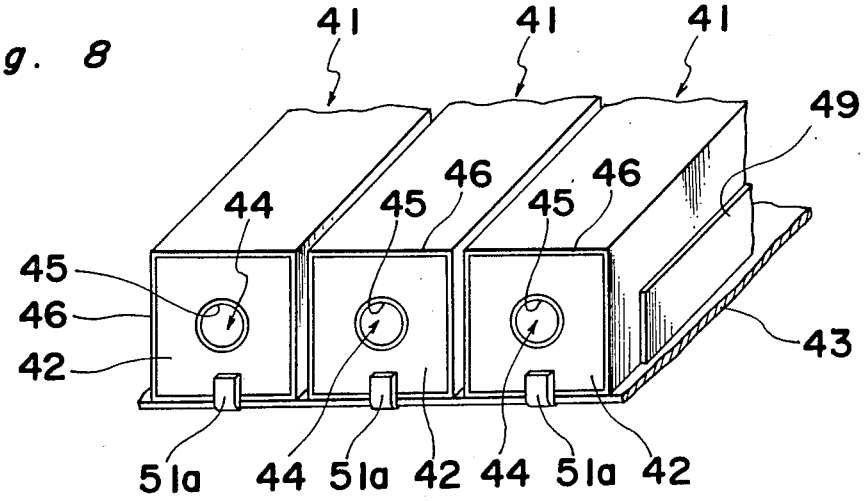
FIGS. 8 and 9 are perspective view showing mounts, with resonators mounted thereon, according to third and fourth embodiments of the present invention, respectively.
Figure 9:
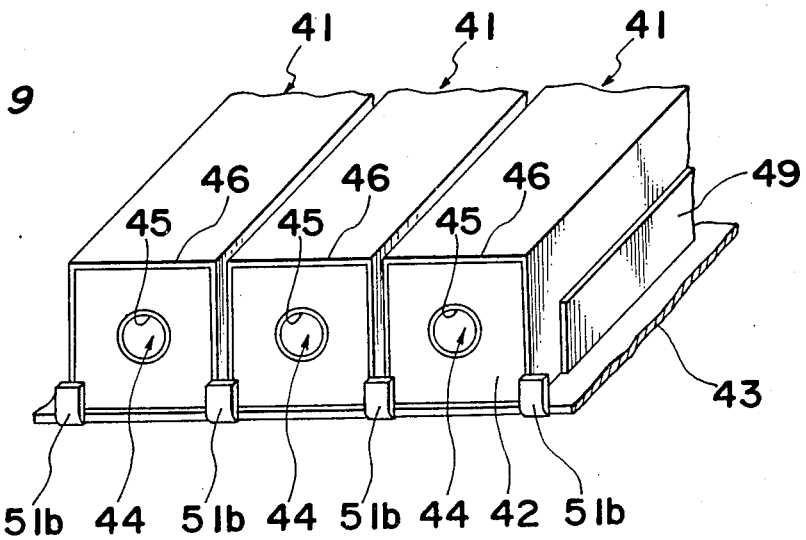

Instead of one of the bent side edges 51 and 52, for example, the bent side edge 51, which contacts the respective ends of the coaxial resonator opposite the ends thereof wher the respective shortcircuiting conductors 47 (FIG. 5) are formed, a plurality of upright tongues 51*a* or 51*b* may be employed as shown in FIG. 8 or FIG. 9, respectively. In particular, in the embodiment shown in FIG. 8, each of the tongues 51*a* contacts that end of the respective coaxial resonator 41 at a location immediately below the hollow 44, whereas in the embodiment shown in FIG. 9, each of the tongues 51*b* contacts that end of the respective coaxial resonator 41 at a location corresponding to one corner region of the coaxial resonator 41.

In the foregoing description, reference has been made to the quarter-wavelength TEM resonator wherein the outer and inner conductors are not shortcircuited with each other.

Although preferred embodiments of the present invention have been described, with reference to the accompanying drawings, it is to be noted note that various changes and modifications are apparent to those skilled in the art. By way of example, the grounded plate 43 with the dielectric coaxial resonators mounted thereof may be housed within a suitable enclosure or may constitute a bottom of a casing for enclosing the coaxial resonators.

Moreover, instead of the solder deposits, deposits of an electroconductive bond or a brazing material may be employed.

Accordingly, such changes and modifications are to be understood as included within the scope of the present invention as defined by the appended claims, unless they depart therefrom.

What is claimed is:

1. An assembly which comprises, in combination:

a plurality of dielectric coaxial resonators each comprising a generally elongated, dielectric body having a polygonal cross-section and a hollow space coaxially defined therein so as to extend through the length of the dielectric body, and also having inner and outer conductors formed respectively on inner and outer peripheral surfaces thereof; and a mount for the support thereon of the coaxial resonators substantially parallel to one another, said mount comprising a conductive main plate having a plurality of upstanding conductive side plates, each of which projects from the main plate, parallel to said length of said resonators, and engages with a respective lengthwise side of one coaxial resonator, and restricts the position of said respective coaxial resonator relative to the mount by the locations of the corresponding side plates;

wherein the side plates are integral with the main plate and are spaced from each other an equal distance sufficient to accommodate each respective coaxial resonator in between its corresponding neighboring side plates; and wherein each of the side plates presents a generally corrugated contact surface for said engagement with said respective resonator.

2. An assembly as claimed in claim 1, wherein said main plate has a respective aperture formed therein adjacent to each said upstanding side plate, and further comprising means for adhering said outer conductor of each siad resonator to a portion of said main plate adjacent said respective aperture.

3. An assemlby as claimed in claim 2, wherein each said outer conductor is conductively adhered to said main plate adjacent said respective aperture.

4. An assembly as clamed in claim 2, wherein each said side plate is substantially the same size and shape as said corresponding respective aperture.

5. An assembly as claimed in claim 4, wherein each said side plate is integral with said main plate and connected thereto by a curved portion which is continuous with said main plate and said side plate.

6. An assembly which comprises, in combination:

a plurality of dielectric coaxial resonators each comprising a generally elongated, dielectric body having a polygonal cross-section and a hollow space coaxially defined therein so as to extend through the length of the dielectric body, and also having inner and outer conductors formed respectively on inner and outer peripheral surfaces thereof; and a mount for the support thereon of the coaxial resonators substantially parallel to one another, said mount comprising a conductive main plate having a plurality of upstanding conductive side plates, each of which projects form the main plate, parallel to said length of said resonators, and engages with a respective lengthwise side of one coaxial resonator, and restricts the position of said respective coaxial resonator relative to the mount by the locations of the corresponding side plates;

wherein the side plates are integral with the main plate and are spaced from each other an equal distance sufficient to accommodate each respective coaxial resonator in between its corresponding neighboring side plates; and wherein the main plate has opposite end plate means which project in the same direction as that in which the side plates project, but at right angles to any one of the side plates.

7. The assembly as claimed in claim 6, wherein one of the end plate means comprises a plurality of tongues.

8. An assembly as claimed in claim 4, wherein said main plate has a respective aperture formed therein adjacent to each said upstanding side plate, and further comprising means for adhering said outer conductor of each said resonator to a portion of said main plate adjacent said respective aperture.

9. An assembly as claimed in claim 8, wherein each said outer conductor is conductively adhered to said main plate adjacent said respective aperture.

10. An assembly as claimed in claim 8, wherein each said side plate is substantially the same size and shape as said corresponding respective aperture.

11. An assembly as claimed in claim 10, wherein each said side plate is integral with said main plate and connected thereto by a curved portion whcih is continuous with said main plate and said side plate.

* * * * *